US006533488B2

(12) United States Patent
Blenkush et al.

(10) Patent No.: US 6,533,488 B2
(45) Date of Patent: Mar. 18, 2003

(54) AIRLESS SPRAYER DRIVE MECHANISM

(75) Inventors: William M. Blenkush, Becker, MN (US); Alexander L. Kapelevich, Shoreview, MN (US)

(73) Assignee: Graco Inc., Minneapolis, MN (US)

( * ) Notice: Subject to any disclaimer, the term of this patent is extended or adjusted under 35 U.S.C. 154(b) by 125 days.

(21) Appl. No.: 09/796,231

(22) Filed: Feb. 28, 2001

(65) Prior Publication Data

US 2001/0029838 A1 Oct. 18, 2001

Related U.S. Application Data

(60) Provisional application No. 60/186,157, filed on Feb. 29, 2000.

(51) Int. Cl.[7] ..... F16C 11/00; F16D 1/12; F16D 3/00; C22B 9/00; C22B 26/00

(52) U.S. Cl. ..... 403/79; 403/376; 403/408.1; 74/579 E; 74/595

(58) Field of Search ..... 403/79, 52, 355, 403/378, 379.1, 379.2, 379.5, 380, 376, 408.1; 74/579 R, 579 E, 593, 595, 25, 40, 41, 46, 48

(56) References Cited

U.S. PATENT DOCUMENTS

| | | | | | |
|---|---|---|---|---|---|
| 3,829,242 | A | * | 8/1974 | Duke et al. | 417/38 |
| 4,253,804 | A | * | 3/1981 | Vanderjagt | 417/534 |
| 5,375,625 | A | * | 12/1994 | Reynolds | 137/625.69 |
| 5,988,135 | A | * | 11/1999 | Moorman et al. | 123/196 W |
| 5,992,708 | A | * | 11/1999 | Gaichuk | 222/402.15 |

* cited by examiner

*Primary Examiner*—Christopher J. Novosad
(74) *Attorney, Agent, or Firm*—Douglas B. Farrow

(57) ABSTRACT

An airless spray pump has a drive train is comprised of a motor having an output gear thereon which drives a combination gear assembly comprised of two gears mounted on a shaft which in turn drives a crank assembly which is comprised of a one-piece eccentric end gear molded together and mounted on a shaft which is supported at both ends to prevent cantilevering and attendant stresses. The crank assembly is offset from the vertical axis of the displacement pump in order to reduce side-loading thereon. A connecting rod is mounted via a pin directly to the top of the displacement rod of the reciprocating pump. Retainer pin clippingly retains the pin in the connecting rod and enables the pin to be removed for servicing without the use of tools other than potentially a screwdriver or other generic tool.

1 Claim, 3 Drawing Sheets

AIRLESS SPRAYER DRIVE MECHANISM

RELATED APPLICATIONS

Provisional U.S. Application serial No. 60/186,157, filed Feb. 29, 2000.

BACKGROUND OF THE INVENTION

Airless sprayers using electric motors have been known and used by contractors for many years. While such units have proven satisfactory, it is always an object of manufacturers of such devices to be able to produce such which are both more reliable and at the same time easier and less expensive to manufacture.

SUMMARY OF THE INVENTION

It is therefore an object of this invention to provide an airless sprayer drive mechanism which may be inexpensively manufactured and yet which exhibits a high degree of reliability.

Towards this end, the drive train is comprised of a motor having an output gear thereon which drives a combination gear assembly comprised of two gears mounted on a shaft which in turn drives a crank assembly which is comprised of a one-piece eccentric end gear molded together and mounted on a shaft which is supported at both ends to prevent cantilevering and attendant stresses. The crank assembly is offset from the vertical axis of the displacement pump in order to reduce side-loading thereon.

A connecting rod is mounted via a pin directly to the top of the displacement rod of the reciprocating pump. Retainer pin clippingly retains the pin in the connecting rod and enables the pin to be removed for servicing without the use of tools other than potentially a screwdriver or other generic tool.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

The drive assembly 10 of the instant invention is provided with an electric motor 12 having a gear 14 located on the end thereof. A combination gear 16 is provided having a first driven portion 16*a* and a driving portion 16*b* thereon all located on a shaft 16*c*.

Figure 1:
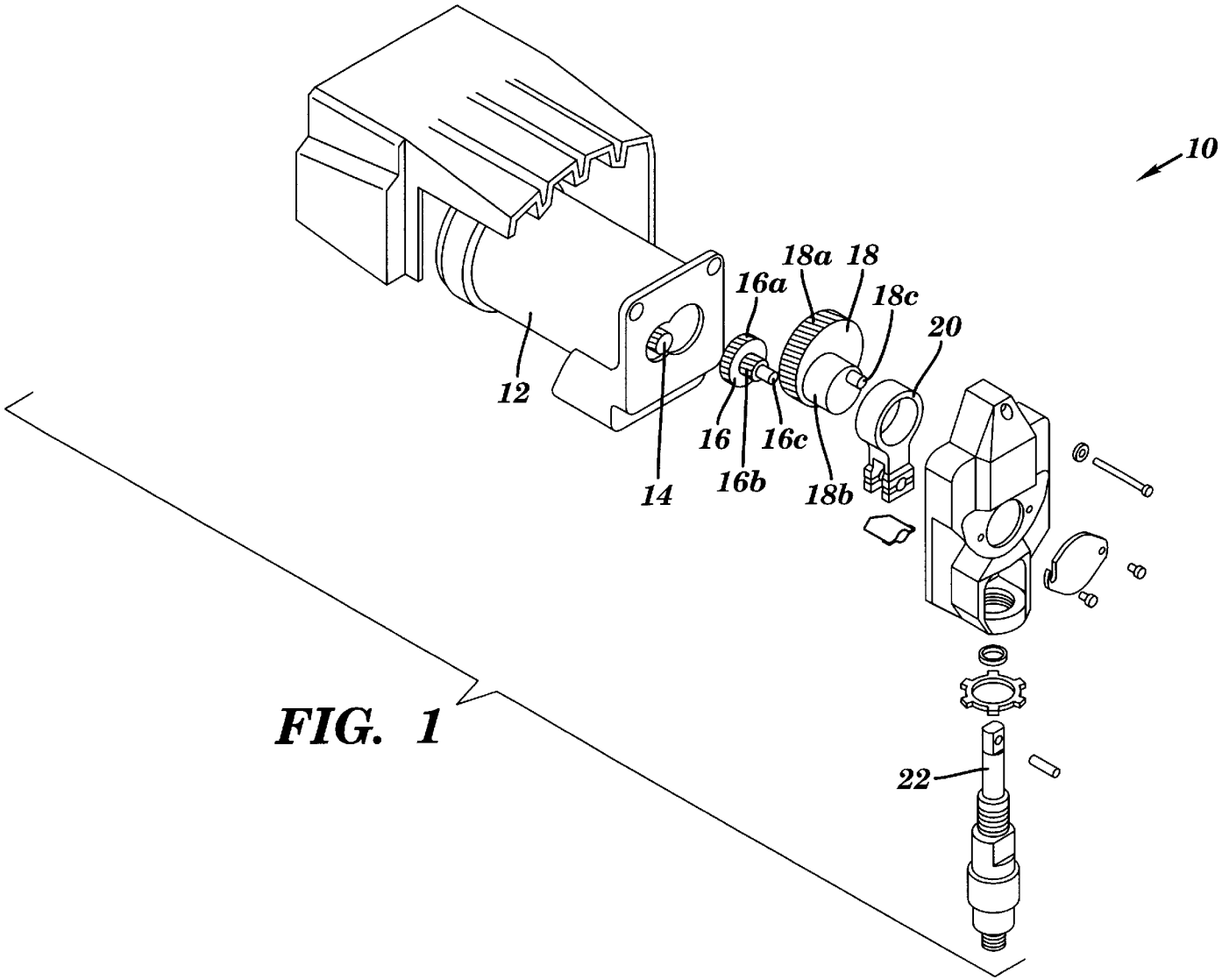
FIG. 1 shows the exploded view of the drive train of the instant invention.
Figure 2:
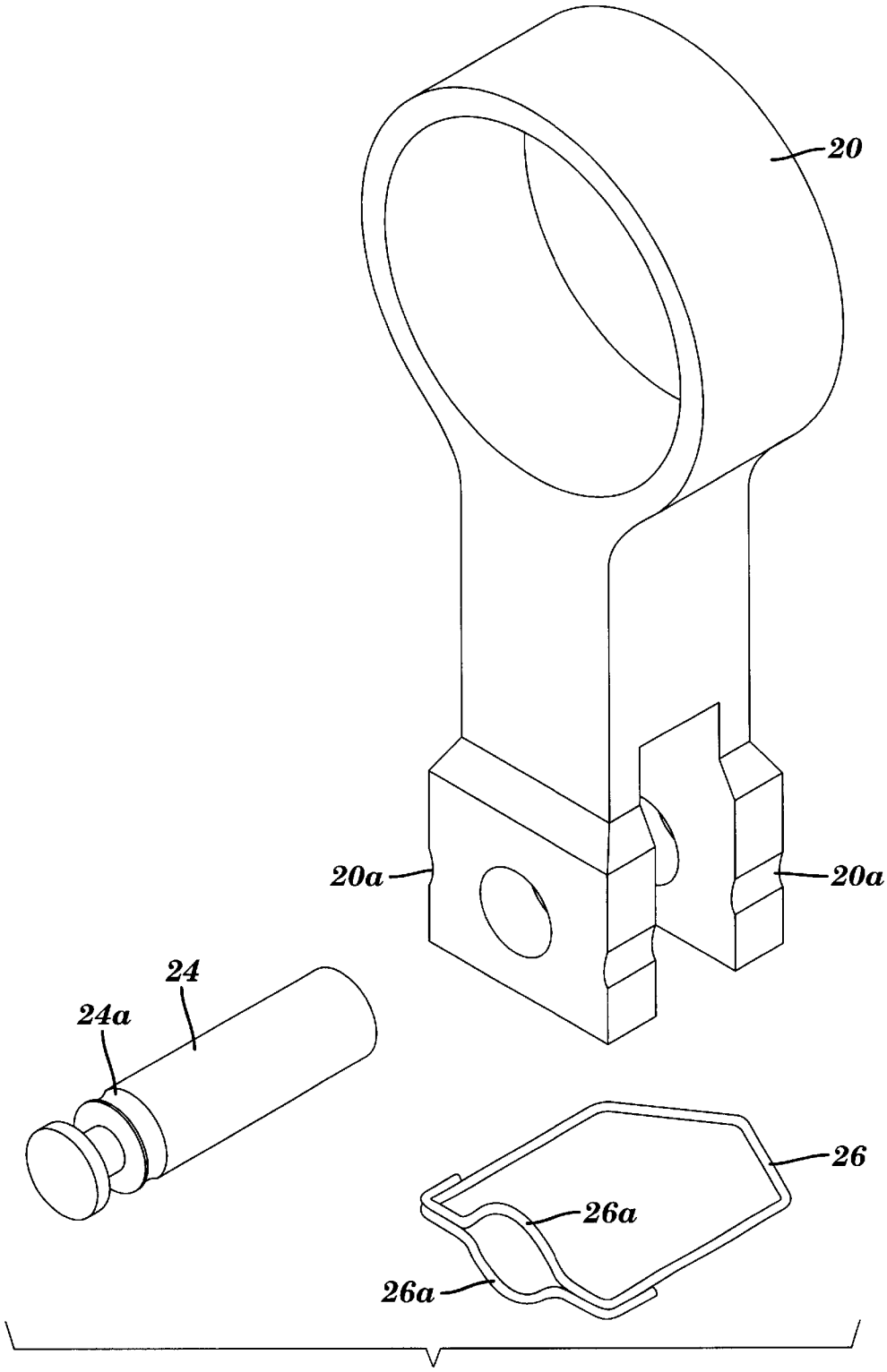
FIG. 2 shows a connecting rod pin and retainer of the instant invention in an exploded form.
Figure 3:
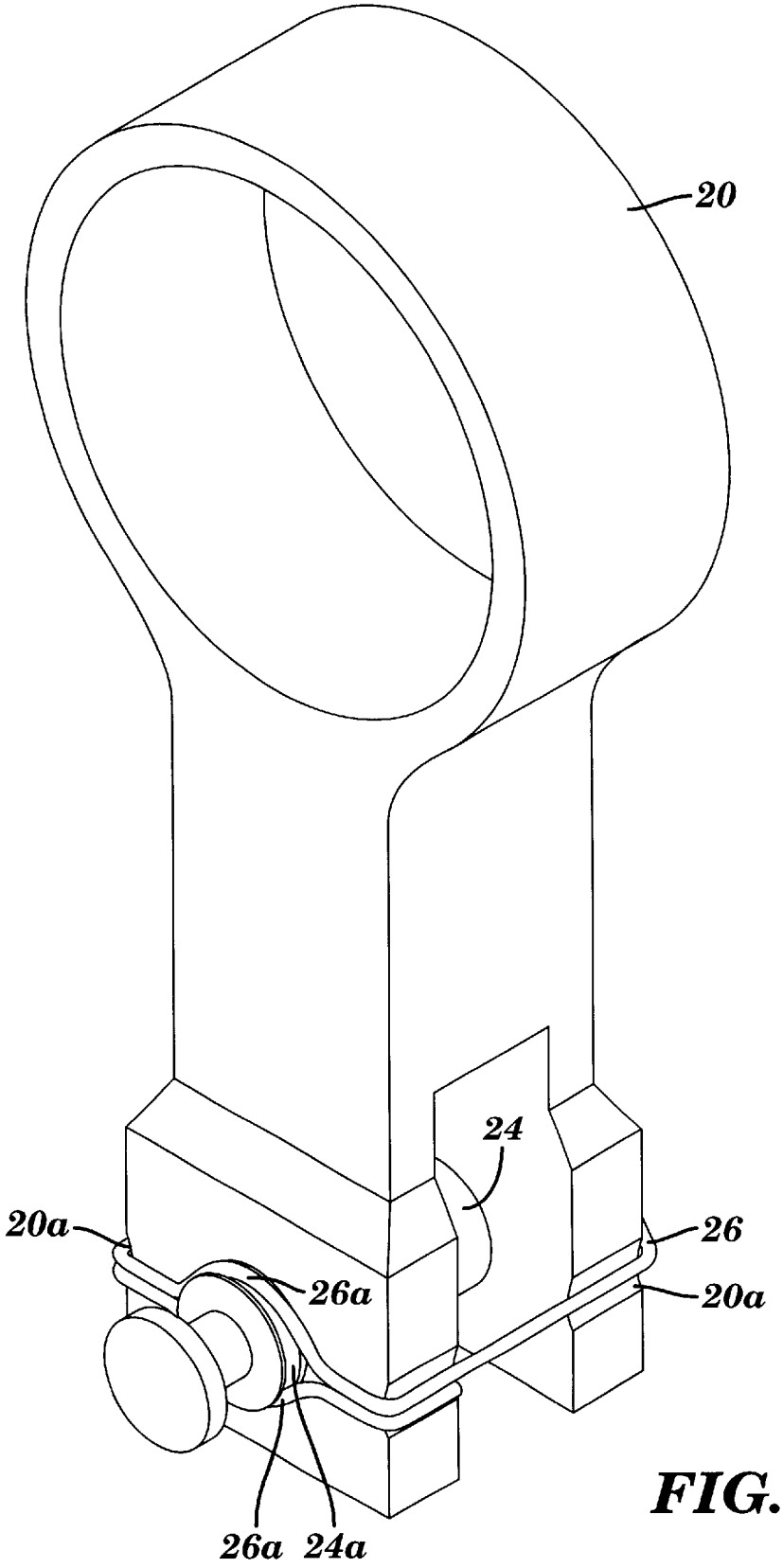
FIG. 3 shows the connecting rod pin and retaining clip in assembled form.

Combination gear assembly 16 in turn drives crank assembly 18 which is comprised of gear 18*a* molded integrally with a crank journal 18*b* which is mounted on a shaft 18*c*. Journal 18*b* rides on the inside of connecting rod 20 which is in turn connected to the top of displacement rod 22 via pin 24 which is held in place with retaining clip 26. As can be seen in FIG. 2, retaining clip 26 is formed of a springable wire and has engaging portions 26*a* which engage on the groove 24*a* of pin 24. Retaining clip 26 is retained in retaining pin 26 bits and groves 20*a* on the outside of connecting rod 20.

It is contemplated that various changes and modifications may be made to the airless sprayer drive mechanism without departing from the spirit and scope of the invention as defined by the following claims.

What is claimed is:

1. In a reciprocating piston pump having a crank, a displacement rod having first and second sides and a connecting rod having first and second sides and connected to said crank and said displacement rod, the improvement comprising:

apertures in said connecting rod and said displacement rod and said displacement rod being located between said connecting rod first and second sides;

a pin slidingly engaged in said connecting rod and said displacement rod apertures; and a springable retaining clip releasably engaging said pin and said connecting rod, said retaining clip contacting said connecting rod on said connecting rod first and second sides to retain said pin in place.

* * * * *